US011029029B2

(12) United States Patent
Lakshmanan et al.

(10) Patent No.: US 11,029,029 B2
(45) Date of Patent: Jun. 8, 2021

(54) FUEL INJECTOR HEAT EXCHANGER ASSEMBLY

(71) Applicant: General Electric Company, Schenectady, NY (US)

(72) Inventors: Varun Swaminathan Lakshmanan, Bangalore (IN); Michael Anthony Benjamin, Cincinnati, OH (US); Veeraraju Vanapalli, Bangalore (IN); Karthikeyan Sampath, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 162 days.

(21) Appl. No.: 16/238,979

(22) Filed: Jan. 3, 2019

(65) Prior Publication Data

US 2020/0217509 A1 Jul. 9, 2020

(51) Int. Cl.

| | |
|---|---|
| ***F23R 3/00*** | (2006.01) |
| ***F23R 3/28*** | (2006.01) |
| *F23R 3/36* | (2006.01) |

(52) U.S. Cl.

CPC ..... *F23R 3/283* (2013.01); *F23R 3/36* (2013.01)

(58) Field of Classification Search

CPC ..... F23R 3/283; F23R 3/286; F23R 3/36
See application file for complete search history.

(56) References Cited

U.S. PATENT DOCUMENTS

| | | | | |
|---|---|---|---|---|
| 4,050,239 | A | 9/1977 | Kappler et al. | |
| 6,276,141 | B1 * | 8/2001 | Pelletier | F23D 11/107 60/740 |
| 6,357,237 | B1 | 3/2002 | Candy et al. | |
| 6,536,216 | B2 | 3/2003 | Halila et al. | |
| 7,712,313 | B2 | 5/2010 | Kojovic et al. | |
| 7,827,795 | B2 | 11/2010 | Hicks et al. | |
| 9,752,774 | B2 * | 9/2017 | Wang | F23D 11/107 |
| 10,161,312 | B2 | 12/2018 | Huntington et al. | |
| 2001/0001171 | A1 * | 5/2001 | Onoda | F02C 3/28 60/776 |
| 2004/0194627 | A1 * | 10/2004 | Huang | F02O 7/224 96/6 |

(Continued)

FOREIGN PATENT DOCUMENTS

| | | | |
|---|---|---|---|
| CN | 103930725 | A | 7/2014 |
| CN | 105229277 | A | 1/2016 |

(Continued)

*Primary Examiner* — Katheryn A Malatek

(74) *Attorney, Agent, or Firm* — Venable LLP; Edward A. Kmett; Michele V. Frank

(57) ABSTRACT

A fuel injector heat exchanger assembly is provided, in which the fuel injector assembly includes a body defining an outer surface and an inner surface. The body includes a plurality of walls in concentric arrangement. The plurality of walls defines a plurality of passages including a first passage surrounded by a second passage, and a third passage surrounding the second passage. Each passage is fluidly segregated from one another by the plurality of walls. A first conduit wall is defined through the body from the outer surface. The first conduit wall defines a first conduit in fluid communication with the second passage. The first conduit wall fluidly segregates the first conduit from the third passage. The first conduit is configured to admit a flow of fluid from outside the fuel injector into the second passage.

20 Claims, 6 Drawing Sheets

(56) References Cited

U.S. PATENT DOCUMENTS

| | | | |
|---|---|---|---|
| 2016/0230998 | A1 | 8/2016 | Frish |
| 2017/0218845 | A1 | 8/2017 | Snyder |
| 2017/0254269 | A1 | 9/2017 | Snyder et al. |
| 2018/0195728 | A1 | 7/2018 | Caruso et al. |

FOREIGN PATENT DOCUMENTS

| | | | |
|---|---|---|---|
| CN | 108019778 | A | 5/2018 |
| CN | 108443911 | A | 8/2018 |
| DE | 102018110969 | A1 | 11/2018 |
| WO | WO00/22347 | | 4/2000 |

* cited by examiner

FUEL INJECTOR HEAT EXCHANGER ASSEMBLY

FIELD

The present subject matter relates generally to fuel injector assemblies for heat engines. The present subject matter relates specifically to heat exchanger systems at fuel injector assemblies.

BACKGROUND

Heat engines, such as gas turbine engines, generally include fuel nozzles that generally suffer from thermal distress due to high operating temperatures in combustion chambers. Downstream portions of fuel nozzles may require cooling fluid to mitigate distress and damage due to high temperatures at the combustion chamber. Although impingement holes and cooling circuits may be provided at downstream portions of fuel nozzles, the extent of mitigation of thermal distress may be limited by the temperature of the cooling fluid. For example, fuel nozzles are often compromised by the temperature of compressed air used as cooling fluid from the compressors as well as limitations on heat transfer to fuel in the fuel nozzle, such as to avoid fuel coking.

As such, there is a need for combustion sections and fuel nozzles that provide improved cooling structures.

BRIEF DESCRIPTION

Aspects and advantages of the invention will be set forth in part in the following description, or may be obvious from the description, or may be learned through practice of the invention.

A fuel injector heat exchanger assembly is provided, in which the fuel injector assembly includes a body defining an outer surface and an inner surface. The body includes a plurality of walls in concentric arrangement. The plurality of walls defines a plurality of passages including a first passage surrounded by a second passage, and a third passage surrounding the second passage. Each passage is fluidly segregated from one another by the plurality of walls. A first conduit wall is defined through the body from the outer surface. The first conduit wall defines a first conduit in fluid communication with the second passage. The first conduit wall fluidly segregates the first conduit from the third passage. The first conduit is configured to admit a flow of fluid from outside the fuel injector into the second passage.

In one embodiment, the fuel injector assembly includes a flange configured to couple to an outer casing. The fuel injector defines a first end proximate to the flange and a second end distal to the first end along the body. The first conduit wall is defined through the body at the first end.

In various embodiments, the body further includes a second conduit wall defined through the body from the outer surface. The second conduit wall defines a second conduit in fluid communication with the second passage. The second conduit wall fluidly segregates the first conduit from the third passage. The second conduit is configured to egress a flow of fluid from the second passage to outside the fuel injector. In one embodiment, the fuel injector assembly includes a flange configured to couple to an outer casing. The fuel injector defines a first end proximate to the flange and a second end distal to the first end along the body. The second conduit wall is defined through the body at the first end. The first conduit wall is defined through the body at the second end distal to the first conduit wall at the first end.

In one embodiment, the fuel injector assembly further includes a head extended from the body. The head defines one or more fuel outlets through which a flow of fuel egresses the first passage and the third passage. The head defines a working fluid outlet through which a flow of working fluid egresses the second passage.

In various embodiments, the fuel injector assembly further includes a fin structure comprising a plurality of fins extended from one or more of the plurality of walls into one or more of the plurality of passages, in which the plurality of fins are in adjacent circumferential arrangement relative to a reference centerline axis. In one embodiment, the plurality of fins of the fin structure is in adjacent radial arrangement relative to the reference centerline axis extended through the body. In another embodiment, the plurality of fins is arranged along the circumferential direction and the radial direction to provide a helical arrangement through one or more of the plurality of passages. In yet another embodiment, the fin structure is extended into the first passage, the third passage, or both. The first passage and the third passage are each configured provide a flow of fuel therethrough. The second passage is configured to provide a flow of working fluid defining compressed air therethrough.

Another aspect of the present disclosure is directed to a heat engine, the heat engine including an outer casing defining an exterior surface and an interior surface. The outer casing defines a diffuser cavity therewithin receiving a flow of compressed air. The fuel injector assembly is coupled to the exterior surface of the outer casing.

In one embodiment, the first conduit wall is defined through the body at the first end.

In another embodiment, the body of the fuel injector further includes a second conduit wall defined through the body from the outer surface. The second conduit wall defines a second conduit in fluid communication with the second passage. The second conduit wall fluidly segregates the first conduit from the third passage. The second conduit is configured to egress a flow of fluid from the second passage to outside the fuel injector.

In various embodiments, the second conduit wall is defined through the body at the first end. The first conduit wall is defined through the body at the second end distal to the first conduit wall at the first end. In one embodiment, the second conduit wall is defined through the body at the first end radially outward of the interior surface of the outer casing. In another embodiment, the second conduit wall is defined through the body at the first end radially outward of the exterior surface of the outer casing.

In one embodiment, the plurality of walls of the fuel injector assembly includes a first wall extended inward of and spaced apart from the inner surface of the body, wherein the first passage is defined within the first wall and a second wall extended inward of the inner surface of the body and outward of the first wall. The second wall is spaced apart from each of the inner surface of the body and the first wall. The second passage is defined between the first wall and the second wall. The third passage is defined between the second wall and the inner surface of the body. The first conduit wall is extended through the body from the outer surface and coupled to the second wall.

In one embodiment, the heat engine further includes a fuel system configured to provide one or more flows of deoxygenated fuel to the first passage and the third passage of the fuel injector assembly. The second passage is configured to receive the flow of compressed air from the diffuser cavity via the first conduit. The fuel injector assembly is configured to egress the flow of compressed air via the second conduit. The one or more flows of fuel and the compressed air are in thermal communication within the body of the fuel injector assembly.

In various embodiments, the heat engine further includes a fin structure comprising a plurality of fins extended from one or more of the plurality of walls into one or more of the plurality of passages. The plurality of fins is in adjacent circumferential arrangement relative to a reference centerline axis. In one embodiment, the plurality of fins of the fin structure is in adjacent radial arrangement relative to the reference centerline axis extended through the body. In another embodiment, the plurality of fins is arranged along the circumferential direction and the radial direction to provide a helical arrangement through one or more of the plurality of passages.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
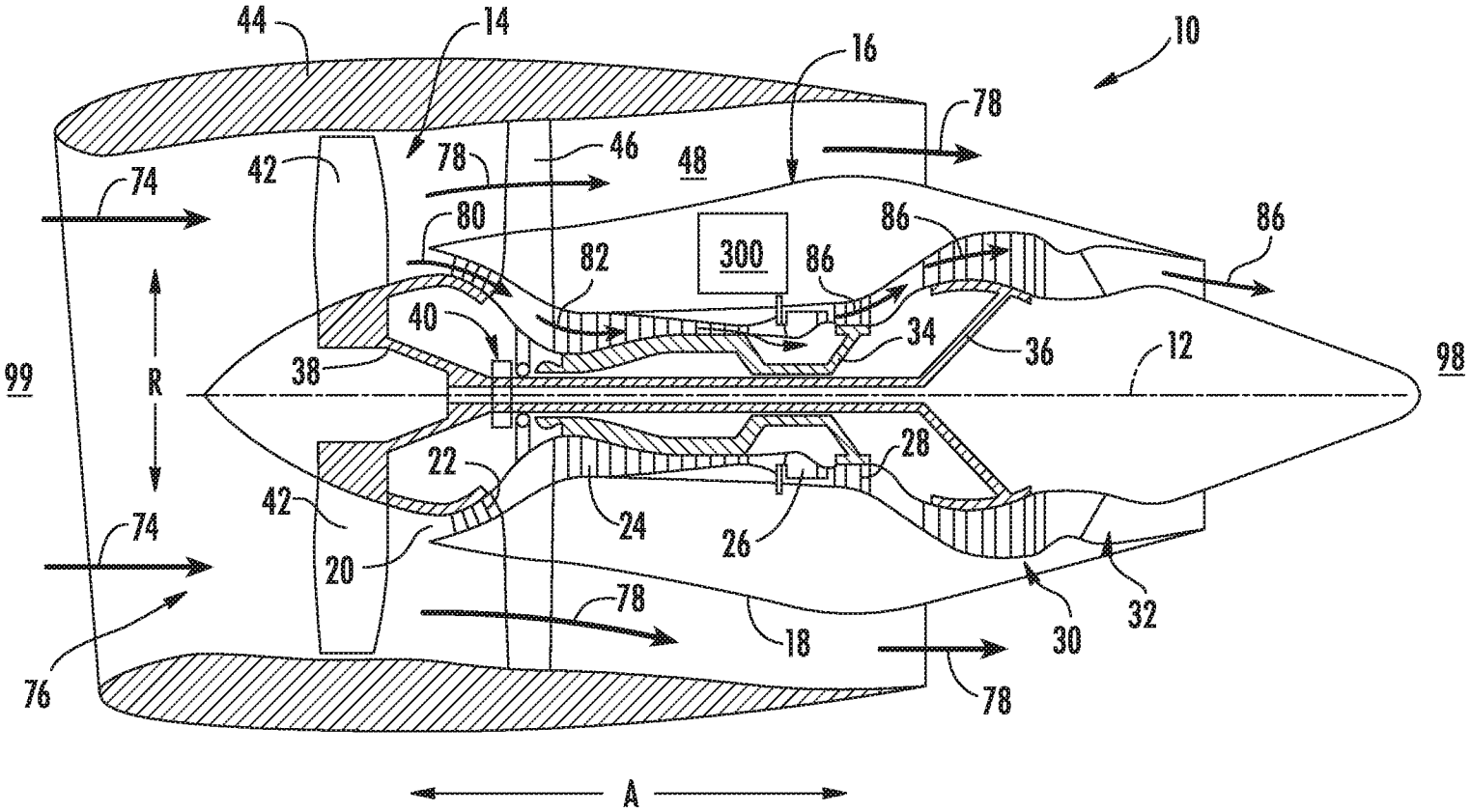
FIG. 1 is a schematic cross sectional view of an exemplary heat engine including a combustion section and fuel injector assembly according to aspects of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Approximations recited herein may include margins based on one more measurement devices as used in the art, such as, but not limited to, a percentage of a full scale measurement range of a measurement device or sensor. Alternatively, approximations recited herein may include margins of 10% of an upper limit value greater than the upper limit value or 10% of a lower limit value less than the lower limit value.

Embodiments of a fuel injector heat exchanger assembly and combustion section are provided that may provide improved cooling to the fuel injector assembly and the combustion section. The embodiments provided herein generally include a body defining an outer surface and an inner surface and including a plurality of walls in concentric arrangement defining a plurality of passages. The plurality of passages provides thermal communication (e.g., heat transfer) between a working fluid, such as compressed air from a compressor section, to a pair or more of fuels surrounding the passage through which the working fluid flows. As the compressed air is generally a significantly higher temperature from the compressor section versus the flows of fuel entering the fuel injector assembly, the fuel removes thermal energy from the working fluid. The working fluid may be provided to a head portion of the fuel injector assembly, or other portions of the combustion section or engine. The cooled working fluid may be provided to a downstream portion, such as an aft heat shield, thermally proximate to combustion gases at the combustion chamber, thereby improving fuel injector assembly durability by reducing a thermal gradient at the fuel injector assembly. In various embodiments, the fuel entering the fuel injector assembly is de-oxygenated at the fuel system such as to mitigate risks of damage at the fuel injector assembly that may be associated with the increased thermal energy received from the working fluid (e.g., coking).

Referring now to the drawings, FIG. 1 is a schematic partially cross-sectioned side view of an exemplary heat engine 10 herein referred to as "engine 10" as may incorporate various embodiments of the present disclosure. Although further described below with reference to a turbofan engine, the present disclosure is also applicable to heat engines, propulsion systems, and turbomachinery in general, including turbofan, turbojet, turboprop, turboshaft, and propfan gas turbine engines, marine and industrial turbine engines, and auxiliary power units. As shown in FIG. 1, the engine 10 has a longitudinal or axial centerline axis 12 that extends there through for reference purposes and generally along an axial direction A. A reference radial direction R is further provided extended from the axial centerline axis 12. The engine 10 further defines an upstream end 99 and a downstream 98 generally opposite of the upstream end 99 along the axial direction A. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 by way of a reduction gear 40 such as in an indirect-drive or geared-drive configuration. In other embodiments, the engine 10 may further include an intermediate pressure (IP) compressor and turbine rotatable with an intermediate pressure shaft.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. In one embodiment, the nacelle 44 may be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
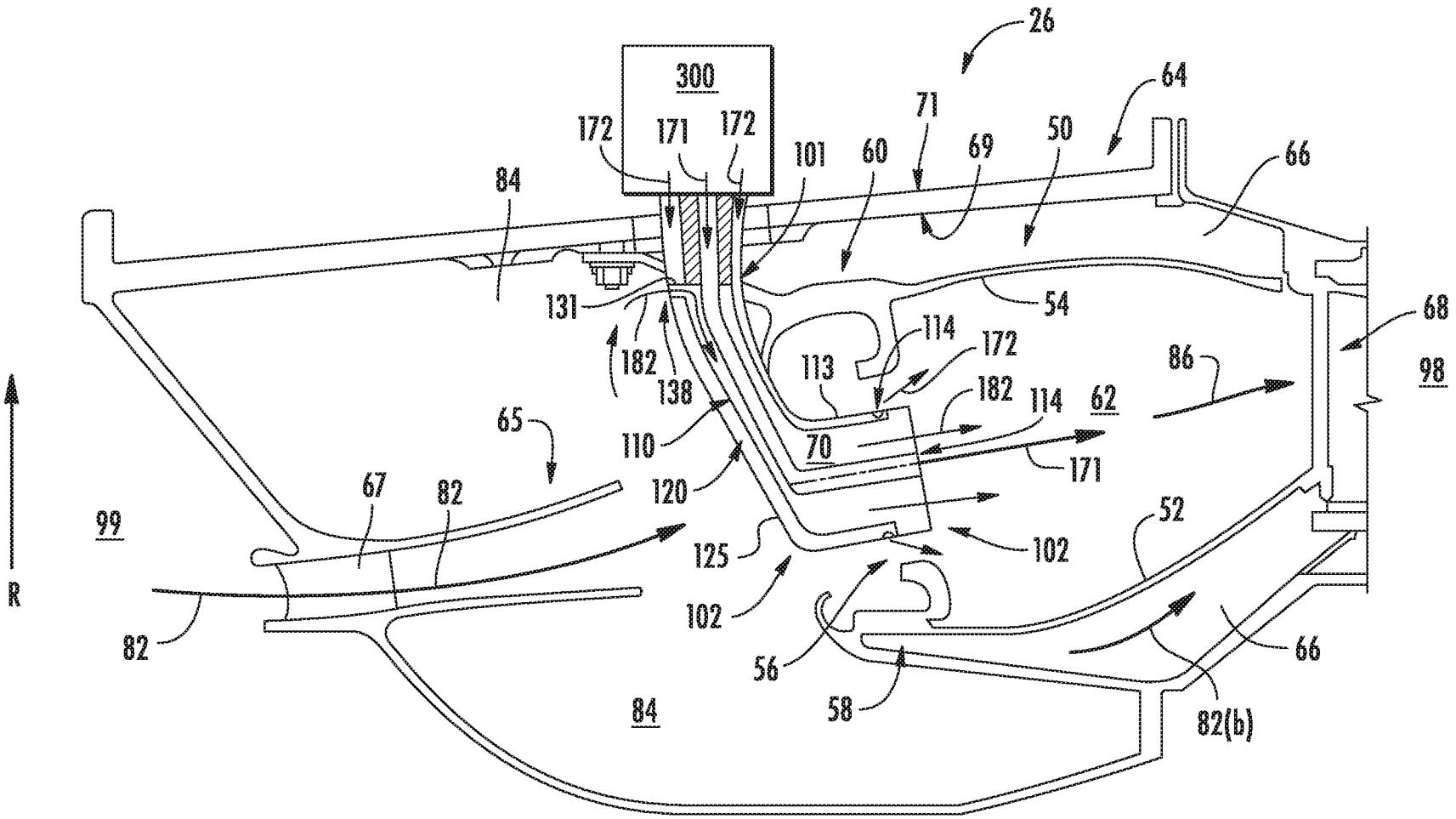
FIG. 2 is a cross sectional view of an exemplary combustion section and fuel injector assembly of the heat engine of FIG. 1 according to an aspect of the present disclosure.

FIG. 2 is a cross sectional side view of an exemplary combustion section 26 of the core engine 16 as shown in FIG. 1. As shown in FIG. 2, the combustion section 26 may generally include an annular type combustor 50 having an annular inner liner 52, an annular outer liner 54 and a dome wall 56 that extends radially between upstream ends 58, 60 of the inner liner 52 and the outer liner 54 respectfully. In other embodiments of the combustion section 26, the combustion assembly 50 may be a multi-annular combustor, such as a can or can-annular type. As shown in FIG. 2, the inner liner 52 is radially spaced from the outer liner 54 with respect to axial centerline 12 (FIG. 1) and defines a generally annular combustion chamber 62 therebetween. However, it should be appreciated that the liners 52, 54, swirlers (not shown), or other components may be disposed from the axial centerline 12 such as to define a multi-annular combustor configuration.

As shown in FIG. 2, the inner liner 52 and the outer liner 54 may be encased within an outer casing 64. An outer flow passage 66 may be defined around the inner liner 52, the outer liner 54, or both. The inner liner 52 and the outer liner 54 may extend from the dome wall 56 towards a turbine nozzle or inlet 68 to the HP turbine 28 (FIG. 1), thus at least partially defining a hot gas path between the combustor assembly 50 and the HP turbine 28.

A fuel system 300 provides one or more flows of fuel 171, 172 to one or more fuel injector assemblies 70 coupled to an exterior surface 69 of the outer casing 64 and extended therethrough. The fuel system 300 may generally define a de-oxygenating fuel system providing flows of substantially or completely de-oxygenated fuel 171, 172 to each fuel injector assembly 70. The fuel may include liquid and/or gaseous flows of fuel. In various embodiments, the flows of fuel 171, 172 are independently metered or controlled such as to provide flow rates, pressures, temperatures, or fuel types different from one another, or different to one or more of the fuel injector assemblies 70.

The fuel injector assembly 70 may extend at least partially through the dome wall 56 and provide a fuel-air mixture to the combustion chamber 62. The fuel injector assembly 70 includes a body 110 extended from the outer casing 64 and radially inward into the combustion section 26. The fuel injector assembly 70 may further include a head 113 that extends at least partially through the dome wall 56 to the combustion chamber 62.

A first end 101 of the fuel injector assembly 70 is defined at or proximate to a flange 150 of the fuel injector assembly 70 that couples to the outer casing 64. The flange 150 is generally extended from an outer wall 125 of a portion of the body 110 of the fuel injector assembly 70. In various embodiments, the outer wall 125 may define a heat shield generally protecting a fuel delivering body 110 of the fuel injector assembly 70 from thermal exposure. The fuel injector assembly 70 further defines a second end 102 distal to the first end 101 along a body 110 or head 113 of the fuel injector assembly 70. The second end 102 may generally correspond to a portion of the fuel injector assembly 70 further downstream from the outer casing 64 relative to flows of fuel 171, 172 provided therethrough to the fuel injector assembly 70. For example, the second end 102 may correspond to a radially inward portion of the body 110 from which the head 113 is extended toward the combustion chamber 62. As another example, the second end 102 may correspond to one or more fuel outlets 114 of the fuel injector assembly 70 through which flows of fuel 171, 172 are provided to the combustion chamber 62.

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows across a compressor exit guide vane (CEGV) 67 and through a prediffuser 65 into a diffuser cavity or head end portion 84 of the combustion section 26.

The prediffuser 65 and CEGV 67 condition the flow of compressed air 82 to the fuel injector assembly 70. The compressed air 82 pressurizes the diffuser cavity 84. The compressed air 82 enters the fuel injector assembly 70 to mix with a liquid and/or gaseous fuel.

Referring still to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

Figure 4:
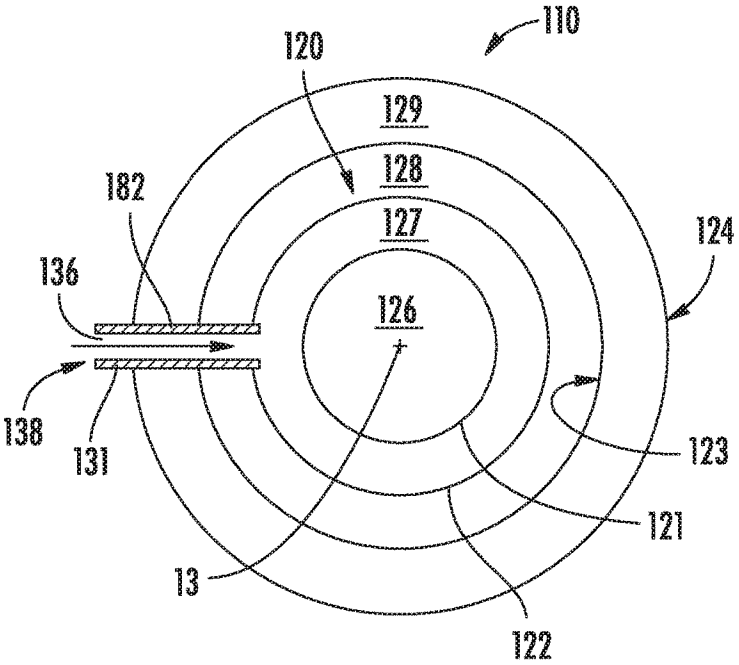
FIG. 4 is an exemplary cross sectional view of the fuel injector assembly of FIG. 3 at plane 4-4.
Figure 3:
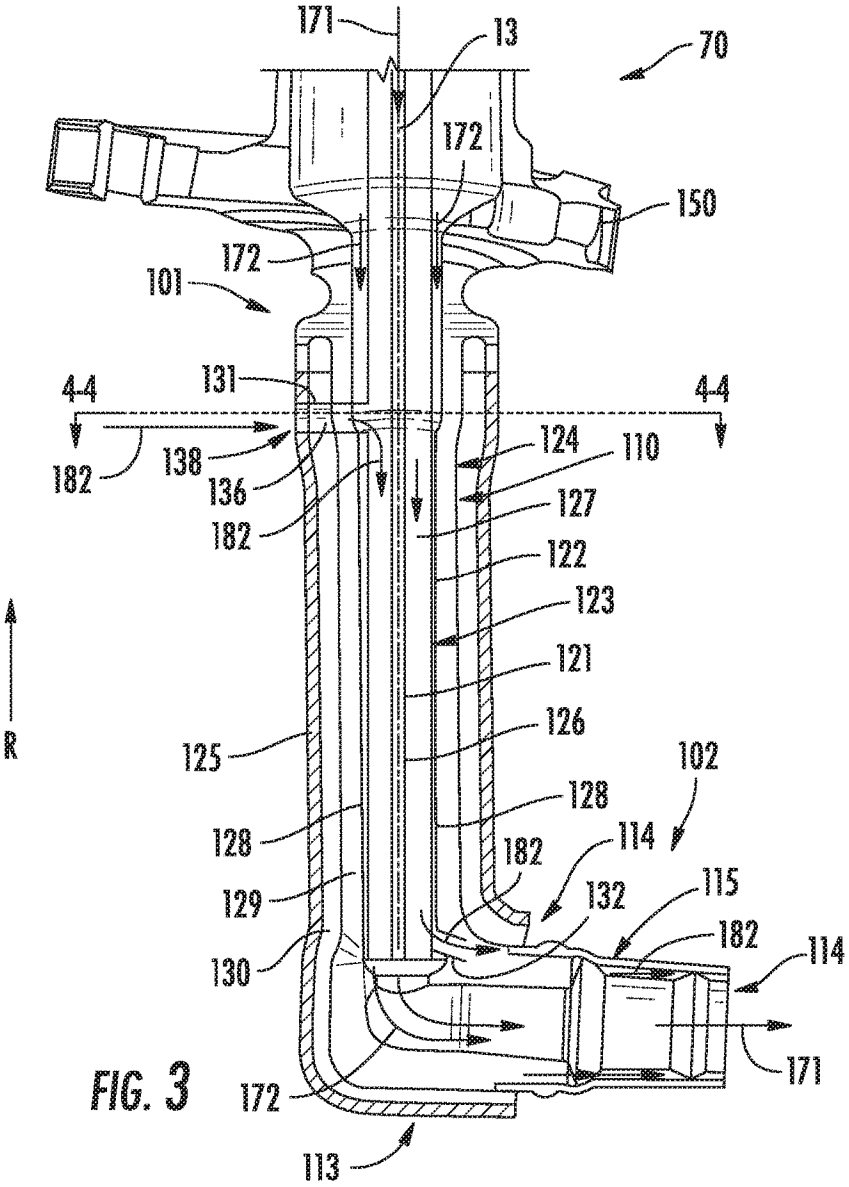
FIG. 3 is a cutaway cross sectional view of an exemplary embodiment of the fuel injector assembly of the combustion section of FIG. 2.

Referring now to FIG. 3, a cutaway view of an exemplary embodiment of the fuel injector assembly 70 according to an aspect of the present disclosure is provided. Referring additionally to FIG. 4, a cross sectional view at plane 4-4 in FIG. 3 of the fuel injector assembly 70 is further provided. Referring to FIGS. 3-4, the body 110 of the fuel injector assembly 70 defines an outer enclosure 124. In various embodiments, the outer enclosure 124 of the body 110 is inward of the outer wall 125 defining a heat shield. An inner wall 123 is extended through the body 110 substantially co-directional to the outer enclosure 124. A first reference centerline axis 13 is defined through the fuel injector assembly 70. The first reference centerline axis 13 generally corresponds to the radial direction R of the engine 10. A plurality of walls 120 is extended through the body 110. In various embodiments, the plurality of walls 120 are each in generally concentric arrangement relative to the first reference centerline axis 13. The plurality of walls 120 defines a plurality of fluidly separated passages between the walls 120 and the inner wall 123 of the body 110.

The plurality of walls 120 includes a first wall 121 extended inward of and spaced apart from the inner wall 123 of the body 110 relative to the first centerline axis 13. A first passage 126 is defined within the first wall 121. A second wall 122 is extended inward of the inner wall 123 of the body 110 and outward of the first wall 121 relative to the first centerline axis 13. The second wall 122 is spaced apart from the inner wall 123 of the body 110 and the first wall 121. A second passage 127 is defined between the first wall 121 and the second wall 122. A third passage 128 is defined between the second wall 122 and the inner wall 123 of the body 110. Each passage 126, 127, 128 is fluidly segregated from one another via each of the plurality of walls 120 therebetween (e.g., the first wall 121 and the second wall 122).

In various embodiments, a fourth passage 129 is defined between the inner wall 123 and the outer enclosure 124. The fourth passage 129 generally defines a volume at which a gas, such as air, or oxidizer generally, or an inert gas, surrounds the passages 126, 127, 128 within the body 110. In still another embodiment, a fifth passage 130 is defined between the outer enclosure 124 and the outer wall 125, such as to define another volume at which a gas, such as air or an oxidizer generally, surrounds the passages 126, 127, 128 within the body 110 and the fourth passage 129 surrounding the body 100.

The fuel injector assembly 70 further includes a first conduit wall 131 defined through the body 110 from the outer wall 125, the outer enclosure 124, or both, and coupled to the second wall 122. The first conduit wall 131 defines a first conduit 136 therewithin in fluid communication with the second passage 127.

During operation of the engine 10, a first flow of fuel, depicted schematically via arrows 171, is provided to the first passage 126 of the fuel injector assembly 70. A second flow of fuel, depicted schematically via arrows 172, is provided to the third passage 128 of the fuel injector assembly 70. The first flow of fuel 171 and the second flow of fuel 172 may each define one or more of a different pressure, flow rate, temperature, or fuel type (e.g., a liquid or gaseous fuel, or combinations thereof). It should be appreciated that the first passage 126 and the third passage 128 may each define different geometries (e.g., different cross sectional areas or volumes) such as to enable different pressures, flow rates, temperatures, etc. of the first flow of fuel 171 relative to the second flow of fuel 172.

A flow of a working fluid, depicted schematically via arrows 182, is provided to the second passage 127 via the first conduit 136 extended from a first opening 138 through the outer wall 125 of the body 110. In various embodiments, the working fluid is a portion of the compressed air 82 from the compressors 22, 24 (FIG. 1). The working fluid 182 provided to the second passage 127 is in thermal communication between first passage 126 and the third passage 128 such as to define the plurality of passages 126, 127, 128 within the body 110 as a heat exchanger.

Referring to FIGS. 1-3, in one embodiment, the working fluid 182, defining a portion of the compressed air 82 exiting the compressors 22, 24 into the combustion section 26 may be approximately 480 degrees Celsius or greater as it enters the second passage 127 through the first conduit 136. However, it should be appreciated that the working fluid 182 may define greater or lesser temperatures based at least on the compressors 22, 24 and an operating condition of the engine 10 (e.g., part load or full load condition, rotor speed, ambient air pressure or temperature, etc.). Generally, the working fluid 182 may define a temperature greater than the flows of fuel 171, 172 entering the fuel injector assembly 70.

Referring to FIG. 3, in one embodiment, the fuel injector assembly 70 includes the first conduit wall 131 and the first conduit 136 defined at the first end 101 of the fuel injector assembly 70. The working fluid 182 enters the second passage 127 and flows substantially co-directional to the first flow of fuel 171 and second flow of fuel 172 through the first passage 126 and third passage 128, respectively. The flows of fuel 171, 172 each egress through one or more fuel outlets 114 at the head 113 of the fuel injector assembly 70.

In various embodiments, a working fluid outlet 115 is defined through the fuel injector assembly 70 through which the flow of working fluid 182 egresses from the fuel injector assembly 70. In one embodiment, such as depicted in regard to FIG. 3, the working fluid outlet 115 is proximate to the fuel outlet 114. In an exemplary embodiment, the working fluid outlet 115 is proximate to the fuel outlet 114 such as to enable the working fluid 182 to flow through the body 110, or additionally, the head 113, in thermal communication with the flows of fuel 171, 172. The thermal communication between the working fluid 182 and the flows of fuel 171, 172 provide for heat transfer from the working fluid 182 to one or more of the flows of fuel 171, 172. The arrangement of the first conduit wall 131 at the first end 101 of the fuel injector assembly 70 and the working fluid outlet 115 at a distal second end 102 of the fuel injector assembly 70 (e.g., at the head 113) provides the working fluid 182 as a cooling fluid to the head 113.

In one particular embodiment, the working fluid outlet 115 is disposed at a portion of the head 113 disposed at the combustion chamber 62 (FIG. 2) or most proximate to heat release from the combustion gases 86 (FIG. 2). The working fluid 182, cooled by the flows of fuel 171, 172 surrounding the working fluid 182 within the fuel injector assembly 70, provides thermal attenuation to the head 113, or more particularly, the second end 102 at the head 113. Such thermal attenuation improves durability of the fuel injector assembly 70, such as by reducing a thermal gradient at the fuel injector assembly 70 associated with heat release at the combustion chamber 62 (FIG. 2).

It should be appreciated that in various embodiments, the working fluid outlet 115 may further define a fuel-air mixing outlet, such as to provide fluid communication between the working fluid 182 and one or more of the flows of fuel 171, 172 at the head 113. It should further be appreciated that fuel-air mixing may be improved via the transfer of thermal energy from the working fluid 182 to one or more of the flows of fuel 171, 172 within the fuel injector assembly 70.

Such increase in thermal energy at the flows of fuel 171, 172 may improve atomization of the fuel 171, 172 as it egresses from the one or more fuel outlets 114 for ignition at the combustion chamber 62. Improved atomization may further improve emissions output or desirably alter heat release characteristics during combustion.

Figure 6:
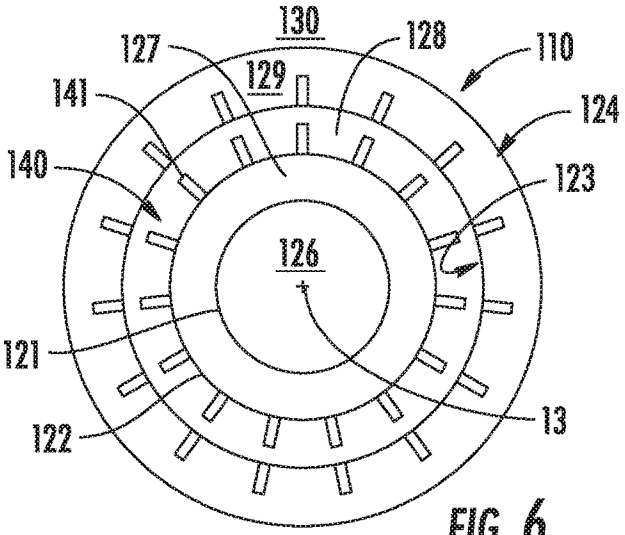
FIG. 6 is an exemplary cross sectional view of the fuel injector assembly of FIG. 5 at plane 6-6.
Figure 7:
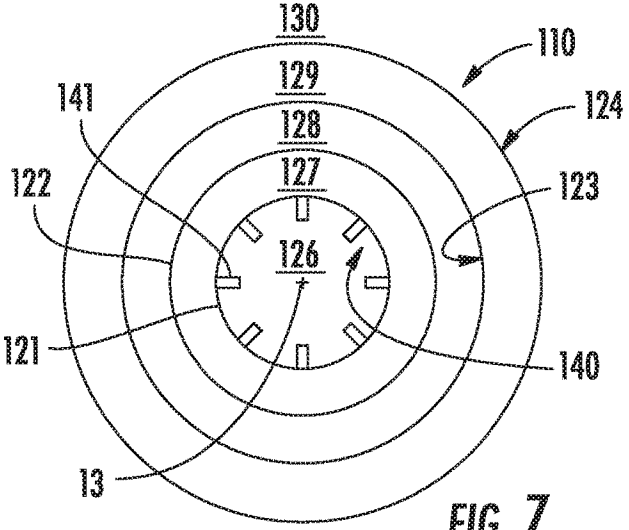
FIG. 7 is another exemplary cross sectional view of the fuel injector assembly of FIG. 5 at plane 6-6.
Figure 5:
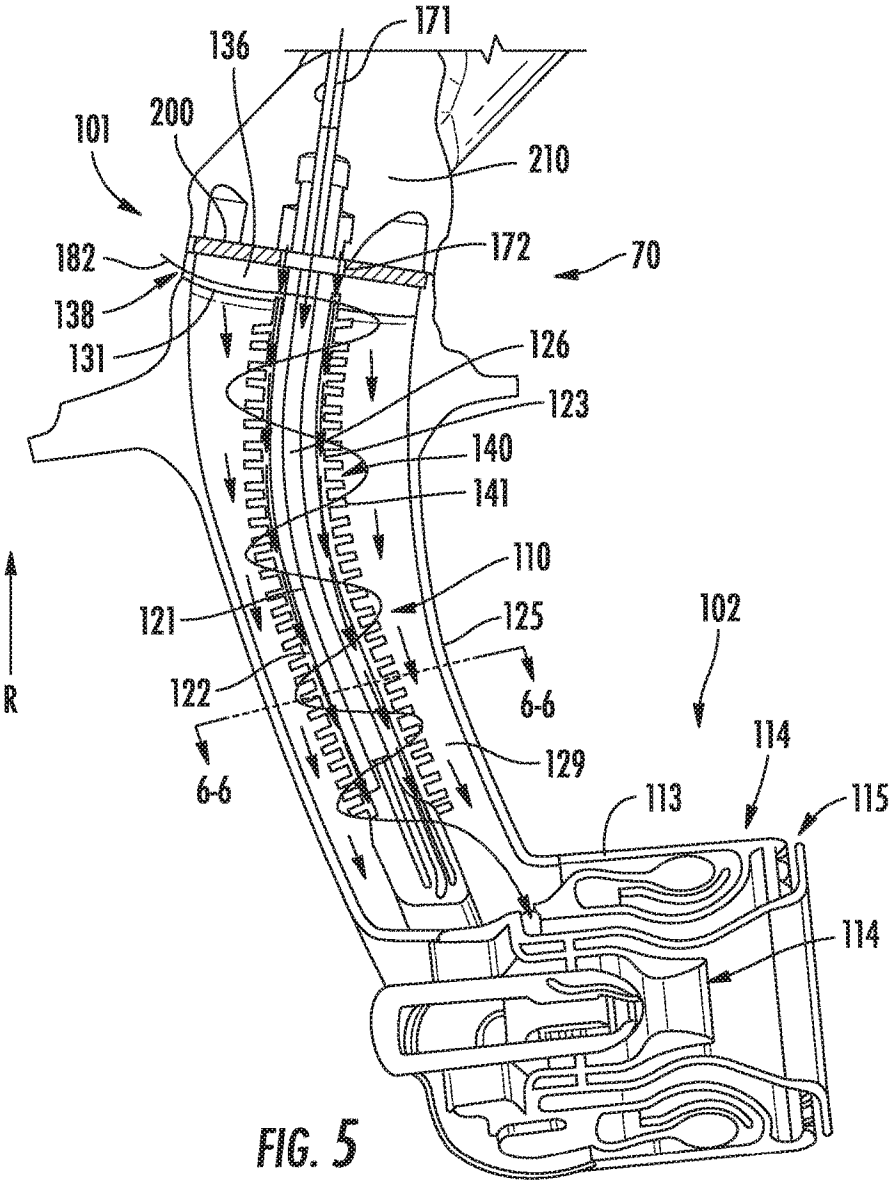
FIG. 5 is a cutaway cross sectional view of another exemplary embodiment of the fuel injector assembly of the combustion section of FIG. 2.

Referring now to FIGS. 5-7, exemplary embodiments of the fuel injector assembly 70 according to aspects of the present disclosure are further provided. The embodiments provided in regard to FIGS. 5-7 are configured substantially similarly as described in regard to FIGS. 2-4. FIG. 5 provides a cutaway cross sectional view of an exemplary embodiment of the fuel injector assembly 70. FIG. 6 provides a cross sectional view at plane 6-6 of FIG. 5. In the embodiments provided in regard to FIGS. 5-6, the fuel injector assembly 70 may further include a fin structure 140 extended from one or more of the walls 121, 122, 123 extended within the body 110. The fin structure 140 includes a plurality of fins 141 disposed in circumferential arrangement relative to the reference centerline axis 13 extended through the body 110. In the embodiment depicted, the plurality of fins 141 is extended into fourth passage 129 from the inner wall 123 of the body 110. In other embodiments, the plurality of fins 141 is extended into one or more passages 126, 127, 128 defined between the walls 121, 122, 123, 124 of the body 110.

The fin structure 140 may promote and improve heat transfer from the working fluid 182 to one or more of the fuels 171, 172 flowing through the body 110. In one embodiment, such as depicted in regard to FIG. 6, the fin structure 140 is extended from the inner wall 123 into the fourth passage 129 such as to promote heat transfer from the working fluid 182 in the second passage 127 to the fuel in the third passage 128. In another embodiment, the fin structure 140 is extended from the second wall 122 into the second passage 127. In yet another embodiment, such as depicted in regard to the exemplary cross sectional view provided in FIG. 7, the fin structure 140 may be extended from the first wall 121 into the first passage 126 such as described in regard to FIG. 6.

Referring back to FIG. 5, in various embodiments, the plurality of fins 141 of the fin structure 140 may further be disposed in adjacent radial arrangement along the radial direction R. For example, the fin structure 140 may be disposed along a flowpath length of the passages 126, 127, 128, 129 through the body 110 from the first end 101 to the head 113. In one embodiment, the plurality of fines 141 is further arranged along the circumferential direction and the radial direction to provide a helical arrangement through one or more of the passages 126, 127, 128, 129. The helical arrangement may provide a substantially helical flowpath of the fuel 171, 172 and/or the working fluid 182. The helical flowpath may increase a residence time of the fluids 171, 172, 182 within the body 110 of the fuel injector assembly 70 such as to increase heat transfer between the fluids 171, 172, 182. The increased heat transfer may further cool the working fluid 182 to further provide one or more benefits described herein.

Figure 10:
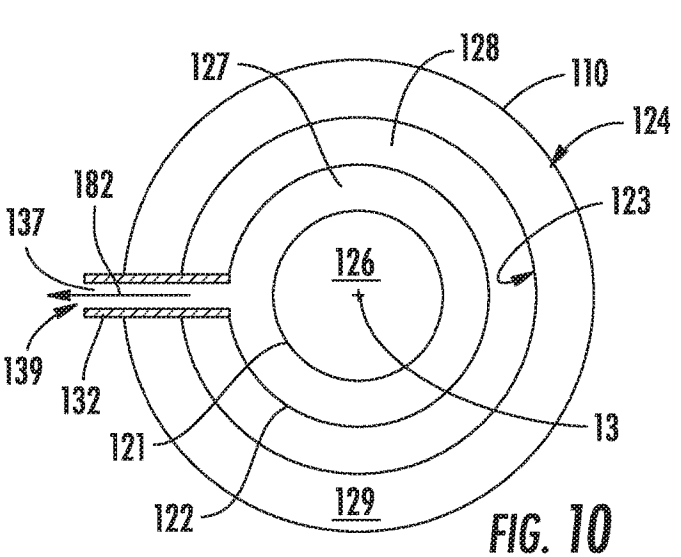
FIG. 10 is an exemplary cross sectional view of the fuel injector assembly of FIG. 8 at plane 10-10.
Figure 9:
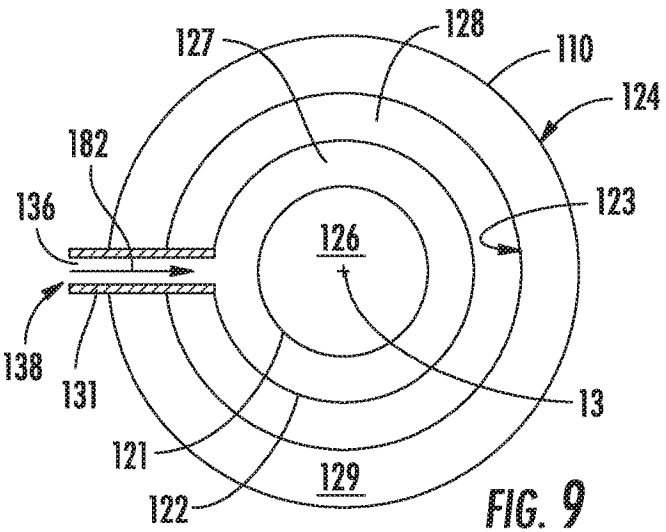
FIG. 9 is an exemplary cross sectional view of the fuel injector assembly of FIG. 8 at plane 9-9.
Figure 8:
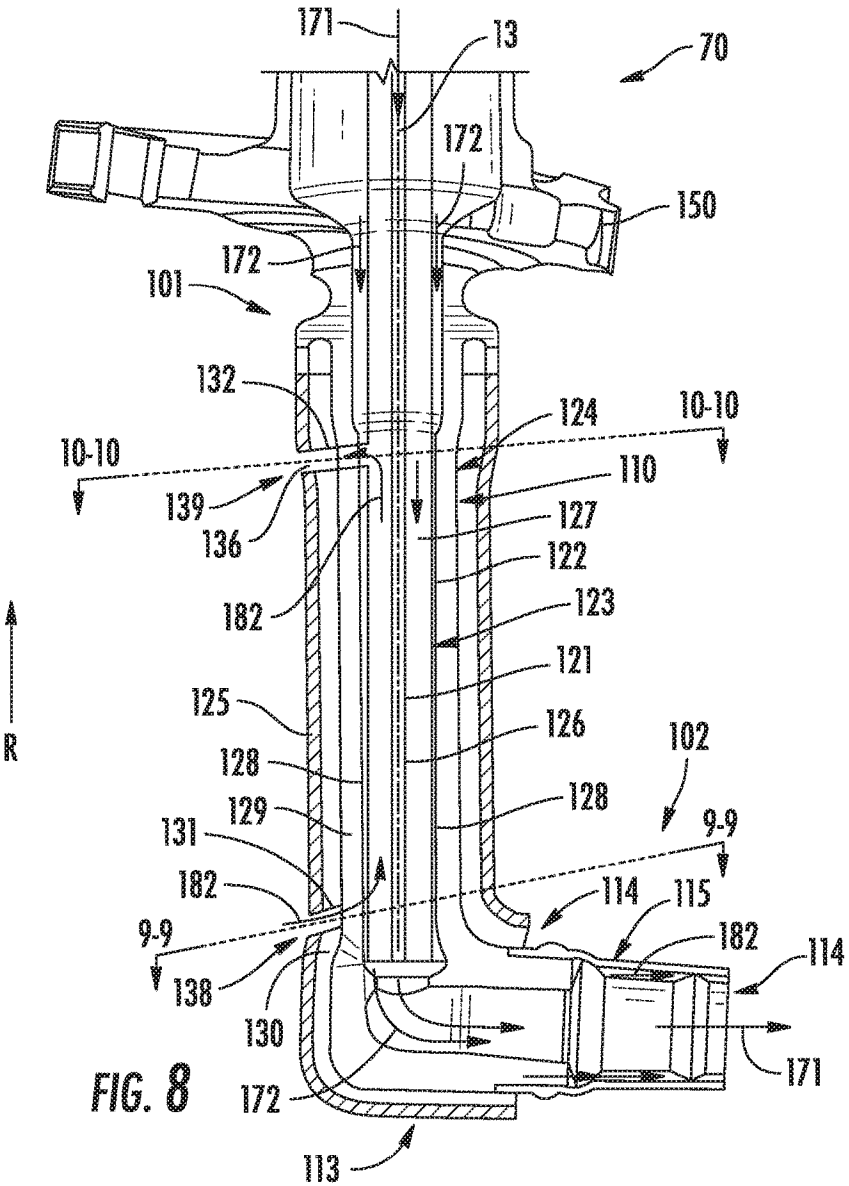
FIG. 8 is a cutaway cross sectional view of another exemplary embodiment of the fuel injector assembly of the combustion section of FIG. 2.

Referring now to FIGS. 8-10, exemplary embodiments of the fuel injector assembly 70 according to aspects of the present disclosure are further provided. The embodiments provided in regard to FIGS. 8-10 are configured substantially similarly to embodiments shown and described in regard to FIGS. 2-7. Regarding FIG. 8, the first conduit wall 131 defining the first conduit 136 in fluid communication with the second passage 127 may be defined at the second end 102 distal to a second conduit wall 132 defining a second conduit 137 at the first end 101. Various embodiments of the second conduit wall 132 are configured similarly as described in regard to the first conduit wall 131. For example, the second conduit wall 132 defines the second conduit 137 in fluid communication with the second passage 127. Additionally, the first conduit wall 131 and the second conduit wall 132 each provide fluid communication between an exterior or outside of the fuel injector assembly 70 to the second passage 127 via the respective first conduit 136 and second conduit 137. Furthermore, the first conduit wall 131 and the second conduit wall 132 each fluidly segregate the working fluid 182 from the third passage 128 disposed between the exterior of the fuel injector assembly 70 and the second passage 127.

Figure 11:
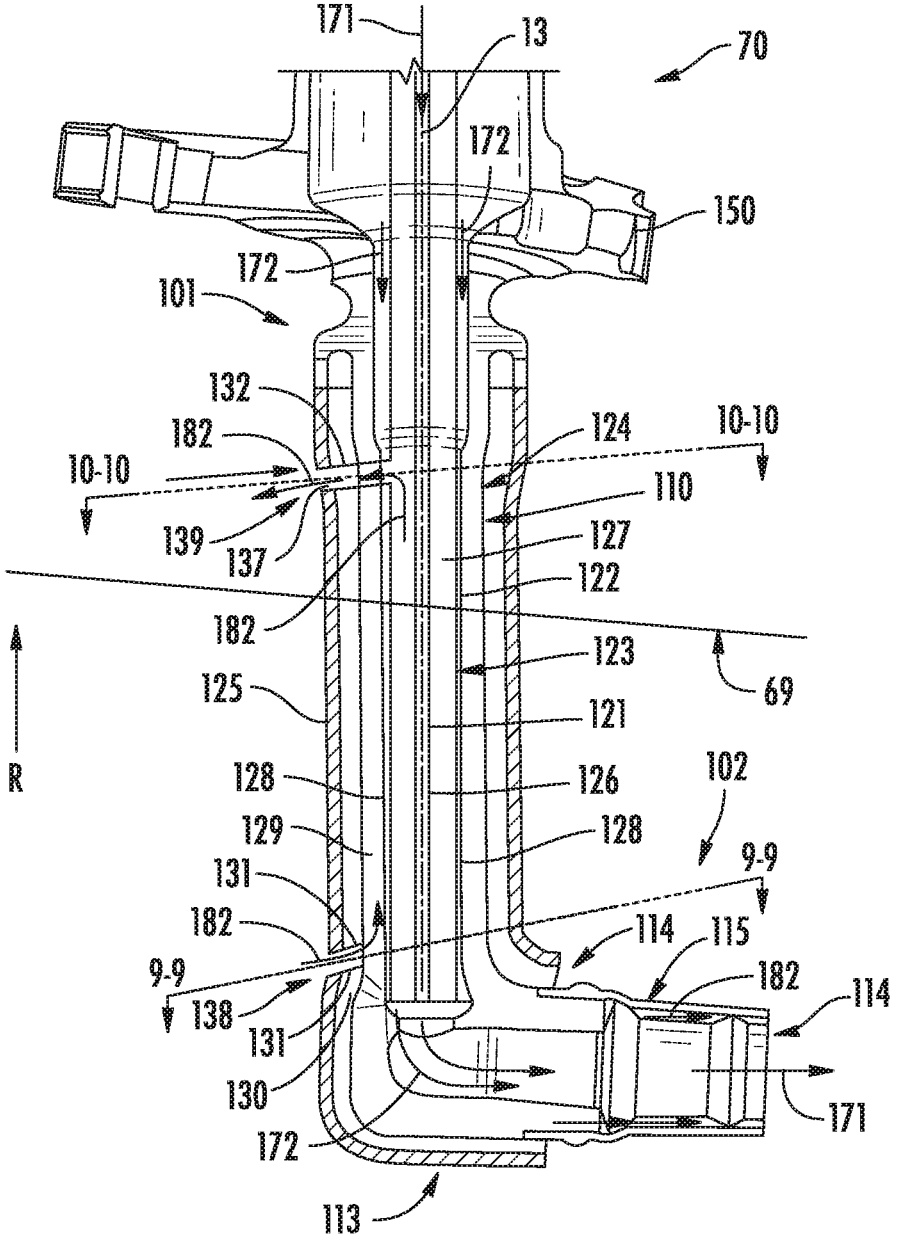
FIG. 11 is a cutaway cross sectional view of another exemplary embodiment of the fuel injector assembly of the combustion section of FIG. 2.

Referring now to FIG. 11, another exemplary embodiment of the fuel injector assembly 70 is provided. The exemplary embodiment provided in regard to FIG. 11 is configured substantially similarly as shown and described in regard to FIGS. 8-10. In FIG. 11, the fuel injector assembly particularly defines the second conduit wall 132 and the second conduit 137 radially outward of an interior surface 69 of the outer casing 64, such as shown schematically by reference plane 69 and further shown in FIG. 2. In various embodiments, the fuel injector assembly 70 may provide a portion of a heat exchanger circuit of the engine 10 in which the working fluid 182, such as a portion of compressed air 82 from the compressors 22, 24, is provided from the diffuser cavity 84 through the fuel injector assembly 70 defining a heat exchanger with the fuels 171, 172 through the fuel injector assembly 70. The working fluid 182 may enter the fuel injector assembly 70 through the first opening 138 to the first conduit 136, flow through the second passage 127 in thermal communication with the fuels 171, 172 in the first passage 126 and third passage 128, and egress from the fuel injector assembly 70 via a second opening 139 at the outer wall 125 of the body 110 at the second conduit 137.

Referring to FIGS. 2 and 11, in one embodiment, the second conduit 137 may be disposed radially outward of the interior surface 69 and radially inward of the exterior surface 71 (FIG. 2) of the outer casing 64. For example, the outer casing 64 may define between the exterior and interior surfaces 69, 71 one or more passages, conduits, or manifolds further defining portions of a heat exchanger circuit of the engine 10. The second conduit 137 is disposed through the body 110 of the fuel injector assembly 70 corresponding to a portion between the exterior and interior surfaces 69, 71 of the outer casing 64 when the fuel injector assembly 70 is installed thereto. The second conduit 137 is further in fluid communication with such passages, conduits, or manifolds between the surfaces 69, 71 of the outer casing 64.

In another embodiment, the second conduit 137 may be disposed radially outward of the interior surface 69 and the exterior surface 71 (FIG. 2) of the outer casing 64 when the fuel injector assembly 70 is installed thereto. The second conduit 137 may be provided in fluid communication with passages, conduits, or manifolds disposed radially outward or outside of the outer casing 64 such as to further provide the cooled working fluid 182 to the heat exchanger circuit. Additionally, or alternatively, the working fluid 182 may be further cooled by another fluid after egressing from the fuel injector assembly 70.

Although not further depicted herein, the fuel injector assembly 70 and the combustion section 26 may include one or more seals, such as between the fuel injector assembly 70 and the outer casing 64. Additionally, in various embodiments, a heat shield 200 (FIG. 5) may be disposed between the first end 101 of the fuel injector assembly 70 and the second passage 127, such as to prevent thermal communication between the working fluid 182 at the second passage 127 and a fuel valve 210 disposed radially outward of the heat shield 200 at the fuel injector assembly 70.

Additionally, or alternatively, the fuel injector assembly 70 may further include additional walls to define additional fluid flow passages therebetween. For example, the first passage 126 may provide a pilot fuel source, such as for promoting ignition or low- or mid-power conditions, such as idle, cruise, or other part-load conditions, or for promoting or advantageously affecting heat release characteristics at the combustion chamber 62 (e.g., pressure oscillations, acoustics, etc.). The third passage 128 may provide a main fuel source such as to provide high-power conditions at the combustion chamber 62, such as take-off or full load conditions. The plurality of walls 120 may further include a third wall or more to provide an additional pilot fuel source, thereby providing a primary and secondary pilot circuit. Embodiments of the fuel injector assembly 70 provided herein may generally provide the second passage 127 surrounded by the first and third passages 126, 128 and in thermal communication therewith. The working fluid 182, such as a portion of compressed air 82 from the compressors 22, 24, is conditioned as a cooling fluid to the head 113 of the fuel injector assembly 70, or more particularly more thermally distressed downstream portions thereof inward into the combustion chamber 62.

The fuel injector assembly 70, the combustion section 26, and the combustor assembly 50 depicted in regard to FIGS. 1-11 and described herein may be constructed as an assembly of various components that are mechanically joined or arranged such as to produce the fuel injector assembly 70 shown and described herein. The fuel injector assembly 70, or portions thereof, may alternatively be constructed as a single, unitary component and manufactured from any number of processes commonly known by one skilled in the art. These manufacturing processes include, but are not limited to, those referred to as "additive manufacturing" or "3D printing". Additionally, any number of casting, machining, welding, brazing, or sintering processes, or mechanical fasteners, or any combination thereof, may be utilized to construct the fuel injector assembly 70 or the combustion section 26. Furthermore, the fuel injector assembly 70 may be constructed of any suitable material for turbine engine combustor sections, including but not limited to, nickel- and cobalt-based alloys. Still further, flowpath surfaces and passages may include surface finishing or other manufacturing methods to beneficially affect drag or otherwise promote heat transfer or advantageously affect fluid flow. Such manufacturing methods or surface finishing may include methods to promote fluid flow, such as, but not limited to, tumble finishing, barreling, rifling, polishing, or coating. Other methods may include those to promote heat transfer or increase residence time of one or more fluids within the fuel injector assembly 70, such as, but not limited to, protuberances, promoting roughness, or other surface features to affect fluid flow rate or heat transfer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A fuel injector assembly, the fuel injector assembly comprising:

a body defining an outer surface and an inner surface, wherein the body comprises:

a plurality of walls in concentric arrangement, wherein the plurality of walls defines a plurality of passages, wherein the plurality of passages comprises a first passage surrounded by a second passage, and further wherein the plurality of walls defines a third passage surrounding the second passage, wherein each passage is fluidly segregated from one another by the plurality of walls;

a first conduit wall defined through the body from the outer surface and extending radially through the third passage to the second passage, wherein the first conduit wall defines a first conduit in fluid communication with the second passage, and wherein the first conduit wall fluidly segregates the first conduit from the third passage, wherein the first conduit is configured to admit a flow of fluid from outside the fuel injector into the second passage; and a second conduit wall defined through the body from the outer surface and extending radially through the third passage, wherein the second conduit wall defines a second conduit in fluid communication with the second passage, and wherein the second conduit wall fluidly segregates the second conduit from the third passage.

2. The fuel injector assembly of claim 1, wherein the fuel injector assembly comprises a flange configured to couple to an outer casing, and wherein the fuel injector defines a first end proximate to the flange and a second end distal to the first end along the body, and wherein the first conduit wall is defined through the body at the first end.

3. The fuel injector assembly of claim 1, wherein the second conduit is configured to egress the flow of fluid from the second passage to outside the fuel injector.

4. The fuel injector assembly of claim 3, wherein the fuel injector assembly comprises a flange configured to couple to an outer casing, and wherein the fuel injector defines a first end proximate to the flange and a second end distal to the first end along the body, and wherein the second conduit wall is defined through the body at the first end, and further wherein the first conduit wall is defined through the body at the second end distal to the first second conduit wall at the first end.

5. The fuel injector assembly of claim 1, further comprising a head extended from the body, wherein the head defines one or more fuel outlets through which a flow of fuel egresses the first passage and the third passage, and further wherein the head defines a working fluid outlet through which the flow of fluid egresses the second passage.

6. The fuel injector assembly of claim 1, further comprising:

a fin structure comprising a plurality of fins extended from one or more of the plurality of walls into one or more of the plurality of passages, wherein the plurality of fins are in adjacent circumferential arrangement relative to a reference centerline axis.

7. The fuel injector assembly of claim 6, wherein the plurality of fins of the fin structure are in adjacent radial arrangement relative to the reference centerline axis extended through the body.

8. The fuel injector assembly of claim 7, wherein the plurality of fins is arranged along the circumferential direction and the radial direction to provide a helical arrangement through the one or more of the plurality of passages.

9. The fuel injector assembly of claim 6, wherein the fin structure is extended into the first passage, the third passage, or both, wherein the first passage and the third passage are each configured to provide a flow of fuel therethrough, and wherein the flow of fluid is compressed air.

10. A heat engine, the heat engine comprising:

an outer casing defining an exterior surface and an interior surface, wherein the outer casing defines a diffuser cavity therewithin receiving a flow of compressed air;

a fuel injector assembly coupled to the exterior surface of the outer casing, wherein the fuel injector assembly comprises:

a body defining an outer surface and an inner surface, wherein the body comprises a plurality of walls in concentric arrangement, and wherein the plurality of walls defines a plurality of passages, wherein the plurality of passages comprises a first passage surrounded by a second passage, and further wherein the plurality of walls defines a third passage surrounding the second passage, wherein each passage is fluidly segregated from one another by the plurality of walls, and further wherein the body comprises a first conduit wall defined through the body from the outer surface and extending radially through the third passage to the second passage, wherein the first conduit wall defines a first conduit in fluid communication with the second passage, and wherein the first conduit wall fluidly segregates the first conduit from the third passage, wherein the first conduit is configured to admit a flow of fluid from outside the fuel injector into the second passage, and further wherein the body comprises a second conduit wall defined through the body from the outer surface and extending radially through the third passage, wherein the second conduit wall defines a second conduit in fluid communication with the second passage, and wherein the second conduit wall fluidly segregates the second conduit from the third passage; and a flange extended from the outer surface of the body, wherein the flange couples the fuel injector assembly to the exterior surface of the outer casing, and wherein the fuel injector assembly defines a first end proximate to the flange and a second end distal to the first end along the body.

11. The heat engine of claim 10, wherein the first conduit wall is defined through the body at the first end.

12. The heat engine of claim 10, the second conduit is configured to egress the flow of fluid from the second passage to outside the fuel injector.

13. The heat engine of claim 12, wherein the second conduit wall is defined through the body at the first end, and further wherein the first conduit wall is defined through the body at the second end distal to the second conduit wall at the first end.

14. The heat engine of claim 13, wherein the second conduit wall is radially outward of the interior surface of the outer casing.

15. The heat engine of claim 14, wherein the second conduit wall is radially inward of the exterior surface of the outer casing.

16. The heat engine of claim 10, wherein the plurality of walls of the fuel injector assembly comprises:

a first wall extended inward of and spaced apart from the inner surface of the body, wherein the first passage is defined within the first wall;

a second wall extended inward of the inner surface of the body and outward of the first wall, wherein the second wall is spaced apart from each of the inner surface of the body and the first wall, and wherein the second passage is defined between the first wall and the second wall, and further wherein the third passage is defined between the second wall and the inner surface of the body, and wherein the first conduit wall is extended through the body from the outer surface and coupled to the second wall.

17. The heat engine of claim 10, further comprising:

a fuel system configured to provide one or more flows of de-oxygenated fuel to the first passage and the third passage of the fuel injector assembly, and wherein the second passage is configured to receive the flow of fluid from the diffuser cavity via the first conduit, and wherein the fuel injector assembly is configured to egress the flow of fluid via the second conduit, and wherein the one or more flows of fuel and the flow of fluid are in thermal communication within the body of the fuel injector assembly.

18. The heat engine of claim 10, further comprising:

a fin structure comprising a plurality of fins extended from one or more of the plurality of walls into one or more of the plurality of passages, wherein the plurality of fins are in adjacent circumferential arrangement relative to a reference centerline axis.

19. The heat engine of claim 18, wherein the plurality of fins of the fin structure are in adjacent radial arrangement relative to the reference centerline axis extended through the body.

20. The heat engine of claim 19, wherein the plurality of fins is arranged along the circumferential direction and the radial direction to provide a helical arrangement through one or more of the plurality of passages.

* * * * *